United States Patent [19]

Hebert

[11] Patent Number: 4,964,341

[45] Date of Patent: Oct. 23, 1990

[54] PROJECTILE WITH RAM AIR-EXTENDIBLE PROBE AND RAM AIR-EXTENDIBLE PROBE ASSEMBLY THEREFOR

[75] Inventor: John R. Hebert, Cockeysville, Md.

[73] Assignee: AAI Corporation, Cockeysville, Md.

[21] Appl. No.: 396,178

[22] Filed: Aug. 21, 1989

[51] Int. Cl.[5] ..... F42B 10/46

[52] U.S. Cl. ..... 102/501; 102/439; 102/473; 102/490; 244/3.1

[58] Field of Search ..... 102/372, 373, 439, 473, 102/490, 501, 517–519; 244/3.1

[56] References Cited

U.S. PATENT DOCUMENTS

| | | | |
|---|---|---|---|
| 2,324,551 | 7/1943 | Albree | 102/501 |
| 3,086,469 | 4/1963 | Gallagher | 102/501 |
| 3,256,816 | 6/1966 | Pilcher II | 102/501 |
| 3,672,304 | 6/1972 | Rogers et al. | 102/501 |
| 4,384,528 | 5/1983 | Moore et al. | 102/519 |
| 4,430,943 | 2/1984 | Bock et al. | 102/522 |
| 4,549,488 | 10/1985 | Hoffmann | 102/522 |
| 4,624,187 | 11/1986 | Bocker et al. | 102/501 |

*Primary Examiner*—Charles T. Jordan
*Assistant Examiner*—Richard W. Wendtland
*Attorney, Agent, or Firm*—Reginald F. Pippin, Jr.

[57] ABSTRACT

An extendible probe projectile and an extendible probe assembly therefor, in which the extendible probe reduces drag on the projectile in its extended position and is moved to its extended locked drag-reducing position by ram air action which is converted into a forwardly acting force on the probe during forward motion of the projectile.

9 Claims, 3 Drawing Sheets

PROJECTILE WITH RAM AIR-EXTENDIBLE PROBE AND RAM AIR-EXTENDIBLE PROBE ASSEMBLY THEREFOR

This invention relates to extendible probe projectiles, and more particularly to a ram air-extendible probe projectile and probe assembly therefor.

In various ammunition, such as telescoped ammunition, it is necessary or desirable to constrain the length of the projectile configuration in the assembled cartridge for various reasons, including overall cartridge length constraints and a desire to maximize the size of the charge containment space or spaces within the cartridge. Such length constraints and maximum charge needs lead to a blunt nose projectile configuration which creates a high drag on the projectile during travel toward a target.

In the prior art, various forms of extendible drag reduction probes have been provided on projectiles in an effort to provide a length constrained projectile with maximized propellant space and which has a reduced drag during travel. To my knowledge these prior art constrictions have relied on springs and other mechanical devices to extend and secure the probe, and it is my understanding that such have all possessed an undesirably high degree of complexity and/or susceptibility to malfunction, or other undesirable characteristics.

It is an object and feature of the present invention to provide an improved extendible probe projectile which is simple and reliable in operation.

Still a further object and feature of the invention is to provide an extendible probe projectile, as well as an extendible probe assembly therefor, which has a minimum of moving parts, having only one moving part in an illustrated embodiment.

A further object and feature is to provide an extendible probe projectile, as well as an extendible probe assembly therefor which is simple in operation and which relies on inertial aerodynamic and frictional forces to release, deploy and lock the probe in extended position.

Still other objects, features and attendant advantages will become apparent to one skilled in the art from a reading of the following detailed description of an illustrative embodiment of the invention, taken in conjunction with the accompanying drawings, wherein.

Figure 1:
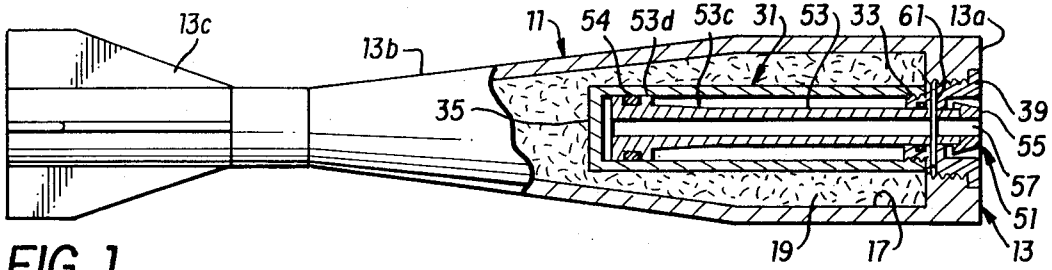
FIG. 1 is a side view partially cut away illustrating a projectile embodiment according to the invention, with the probe in its initial and retracted position prior to launch of the projectile.

Referring now in detail to the Figures of the Drawings, in the illustrative embodiment of FIGS. 1–5, a projectile 11 has a hollow body 13 the front end **13*a* of which is blunt-nosed and the rear section 13*b* of which is tapered, with conventional stabilizing fins 13*c* thereon. Nested within the blunt-nosed end portion of the body is an extendible probe 51**.

Probe 51 is illustrated as a part of a probe assembly 31 having a housing 33, 39 which may be removably secured within the projectile body 13 as by its removable base or bushing 39. Bushing/base 39 has a bore **39*b* within which the probe 51 may slidably move longitudinally, and is removably threadedly secured within the front wall 13*a* of the projectile body 13 as indicated at 39*t***.

A charge-containing chamber for a desired charge load 19 is formed within the hollow projectile body 13, which chamber is defined exteriorly by the side walls 17 and blunt front end wall **13*a* of projectile body 13 and internally by the probe assembly housing 31. As will be noted, the blunt nose of the projectile 11 enables maximizing of the load chamber volume, assuming the constraints imposed by the tapered finned rear section 13*b*, while the extendible probe 51 enables the formation of an effectively longer projectile with an effectively drag-reducing extended nose 55** after a brief initial flight period, as will be later described in more detail.

Housing 33, 39 is formed by externally threaded bushing/base 39 and an elongated cup 33 having a closed end wall 35 and a cylindrically hollow side wall **33*a* forming a guide bore for the enlarged rear piston portion of the probe 51. Cup 33 is suitably secured to bushing/base 39 as by a threaded connection 33*t***.

Probe 51 has a main slide shaft 53 forming the major extent of its length and which slidably rides within guide bushing/base 39, with an enlarged rear piston section **53*d* which slidably rides within cylindrical guide wall 33*a*. An air containment chamber 41 is formed by the end wall 35, side wall 33*a* and the end wall of piston 53*d*, which piston 53*d* has an annular O-ring seal 54 thereon for better sealing engagement with the wall 33*a* while enabling desired substantially free or low-friction sliding movement of the probe 51 along the major portion of its movement toward its extended position. Likewise, guide bore 39*b* of bushing/base 39 has an internal O-ring seal 38 which effectively aids in sealing the zone around the shaft 53**.

Probe 51 has a nose tip 55 secured thereto as by a threaded connection **53*t*, and which may have various forward nose end configurations as may be deemed desirable for particular given conditions. The probe 51 in the illustrative embodiment of FIGS. 1–5 has a frusto-conical shape nose end 55 with a flared or tapered surface 55*b* and flat end 55*a*, while the modified probe 151 of FIGS. 6 and 7 has a top. hat-shaped nose tip 155** configuration, the latter configuration having been found to be a more preferred embodiment as a result of wind tunnel tests.

Figure 2:
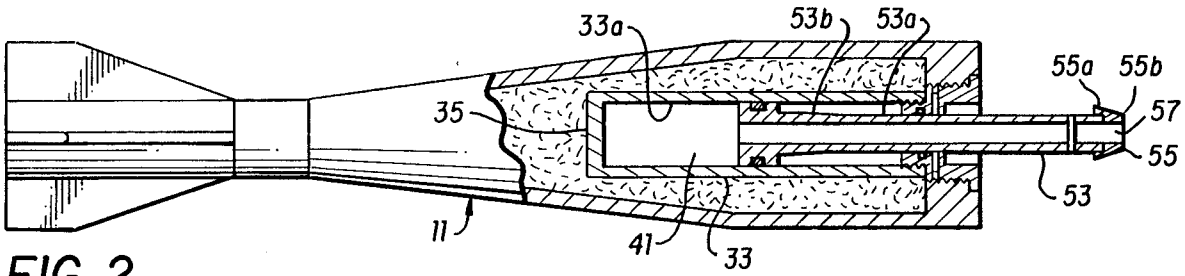
FIG. 2 is a view similar to FIG. 1 showing the probe approximately midway along its extension path of travel.
Figure 3:
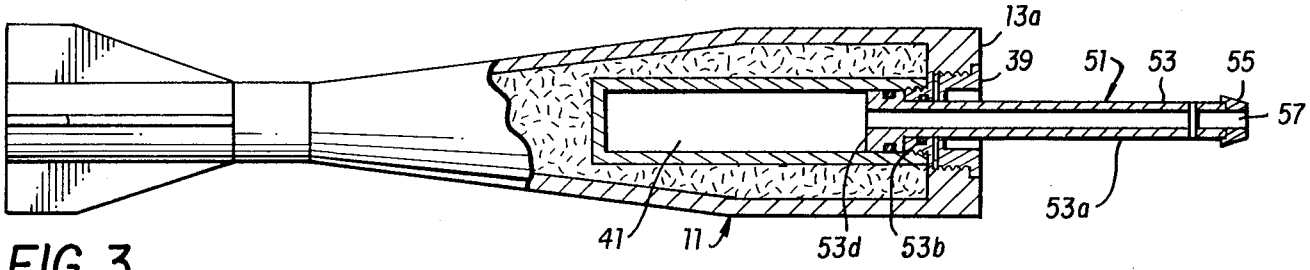
FIG. 3 is a view similar to FIG. 1 showing the probe in its extended and locked position.
Figure 5:
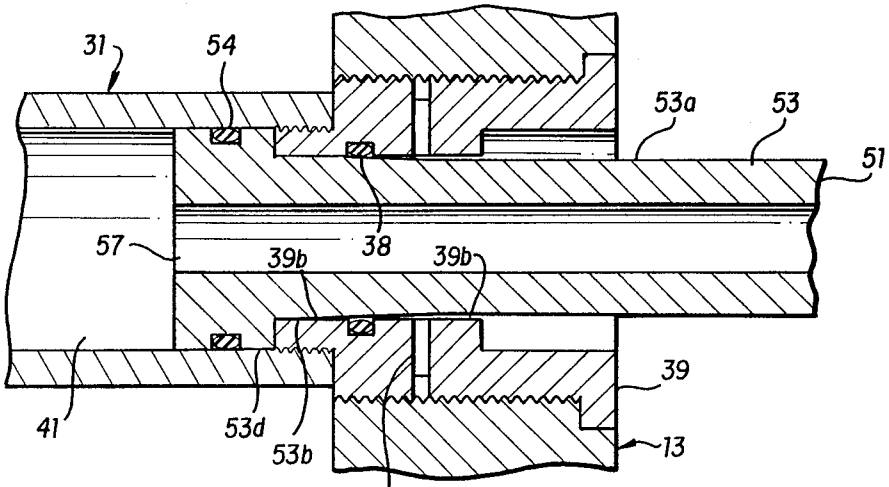
FIG. 5 is an enlarged view of the rear end of the probe in its extended locked position.

Probe 51 has a fluid passageway formed by a bore 57 extending longitudinally through the length of tip 55, shaft 53 and a shaft piston **53*d* and communicating with chamber 41. Chamber 41 effectively forms fluid flow restriction means which receives fluid in the form of air passing through the bore 57 during forward motion of the projectile 11, and the resulting restriction of ram air flow after passage through the bore 57 creates a forwardly acting substantial fluid pressure on the rear end surface of probe piston 53*d*. This force combined with the forward acting inertial force of the probe 51 during abrupt deceleration of the blunt-nosed projectile 11 upon exit from a launch barrel (not shown) overbalances the combined internal friction resistance to probe movement and the normal rearward drag force acting on the probe tip or nose 55 as it moves forward in the air immediately after muzzle exit, and the resultant combined imbalanced forward-acting force on the probe 51 serves to drive the probe 51 forward toward and to its desired fully extended and locked-in-place position as shown in FIGS. 2, 3 and 5**.

Figure 4:
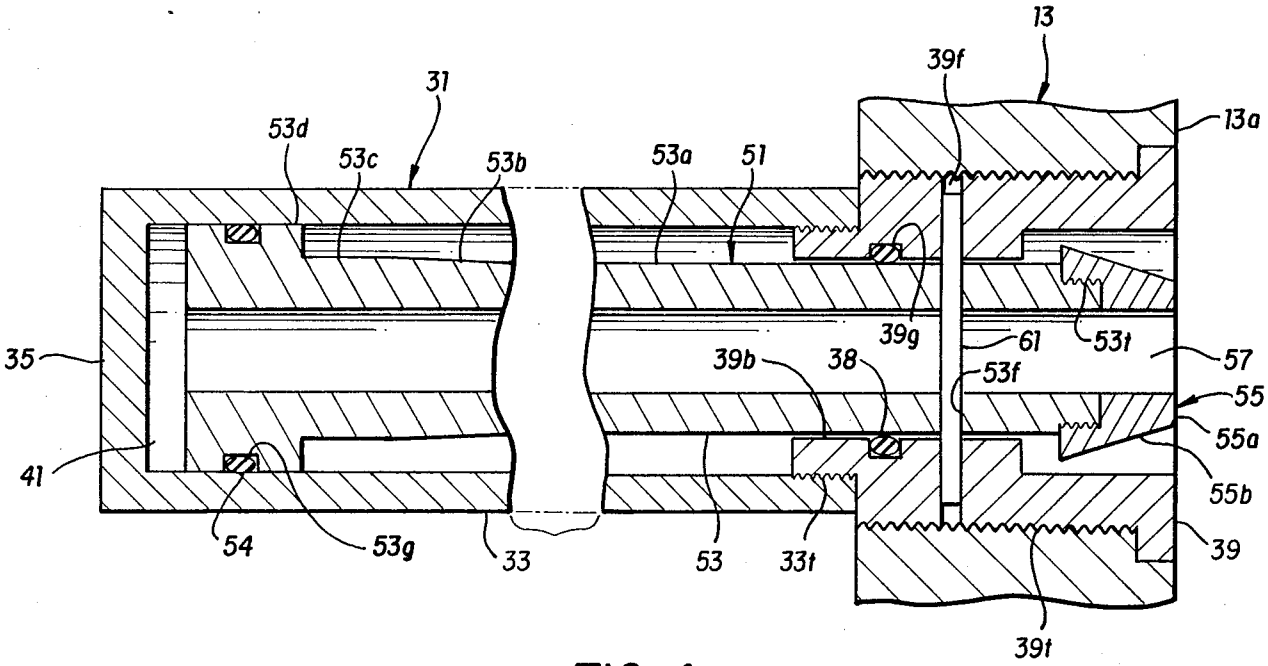
FIG. 4 is an enlarged view of the probe assembly of FIG. 1, shown prior to extension.

The probe 51 is initially retained in a retracted position in its prelaunch state, as shown in FIGS. 1 and 4, being retained in this position by a shear pin 61 extending through a transverse bore **53*f* in shaft 53, and which shear pin 61 is anchored in a transverse bore 39f in guide bushing/base 39. In this position the probe 51 may be totally or largely contained within the bounds of projectile body 13, with the rear end surface of piston 53*d* spaced a short distance forward from housing cup end wall 35, so as to enable set-back shearing of the shear pin 61, which thereby frees the probe 51 for ram air forced forward movement to its forward extended position. The set-back force on the probe during projectile acceleration within a barrel generally prevents the probe from extending while in the barrel. However, once the projectile 11 exits the barrel, there is an initially high deceleration of the projectile 11 because of the projectile's blunt nose. This deceleration, combined with the dynamic ram air pressure acting on the rear end surface of probe piston 55*d*, produces a forwardly acting force which is greater than the sum of the drag force acting on probe tip 55 and the internal frictional resistance to movement of the probe 51**.

The great majority of the length of shaft 55 is generally relatively easily slidable within guide bore **39*b*; however, the rear end zone 53*c* of the shaft 53 adjacent the piston 53*d* is enlarged to form an interference friction fit with bushing bore 39*b*. Thus, as the probe 51 is driven forward relative to the projectile 11 with substantial energy by the combined forces resulting from air pressure acting on its piston rear surface and the forward acting inertia of the probe coupled with the abrupt deceleration of the projectile 11 upon exit from the launch muzzle, the probe 51 will be quickly moved forward to its forwardmost terminal position with sufficient energy to be jammed and held tightly within the guide bushing/base 39 through the resulting interference friction fit between guide bore 39*b* and radially enlarged shaft rear portion 53*c*, as shown in FIGS. 3 and 5**, thereby effectively locking the probe in its extended position.

In one illustrative embodiment constructed according to the invention, ram air which is injected through the fluid passageway 57 of the probe 51 of projectile 11 traveling at approximately 3000 ft/sec creates ram air pressure of approximately 73 lb/in$^2$ within chamber 41, and the combined force from this ram air pressure and the forward inertial force of the probe during post-muzzle exit deceleration of the projectile 11, drives the probe 51 forward to its fully extended locked-in-place position in approximately 0.013 seconds, or after approximately 40 feet of projectile travel from the muzzle at the given 3000 ft/sec projectile velocity.

The resultant extended probe configuration of the projectile modifies the fluid (air) flow around the projectile to reduce the drag which would otherwise be inordinately large due to the blunt nose shape of projectile body 13. The length of the probe, when fully extended, causes the Mach cone to pass outside of the blunt nose of the body, with the flow interior of the shock wave being stagnated, thus effectively providing a nose cone for the projectile at supersonic speeds.

Figure 7:
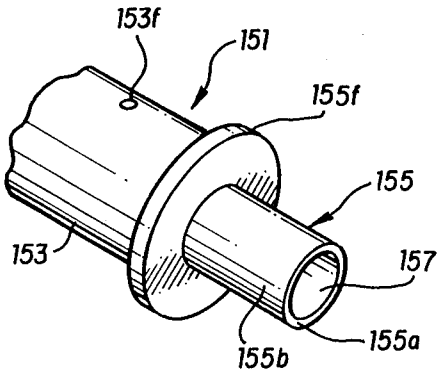
FIG. 7 is a perspective view of the modified probe tip of FIG. 6.
Figure 6:
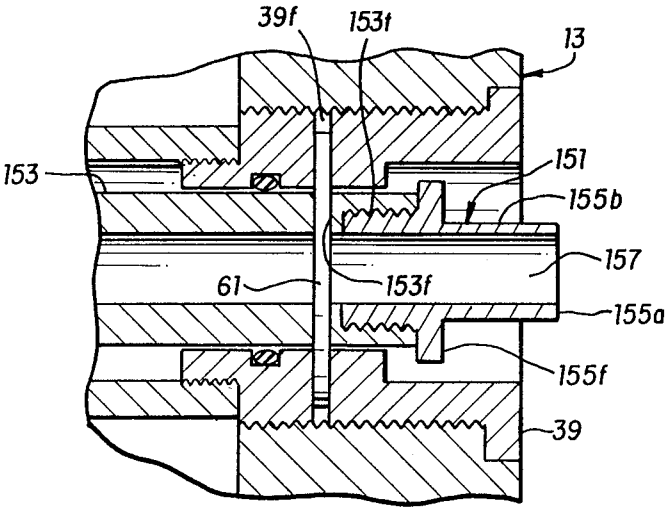
FIG. 6 is a longitudinal section view of a portion of a projectile illustrating a modified probe tip arrangement.

In FIGS. 6 and 7, a modified probe tip configuration is illustrated on a probe 151 which may otherwise be identical to the probe of FIGS. 1–5. In this embodiment, the probe tip 155 has a stepped configuration **155*a*, 155*b*, 155*f***, which has shown preferred results in wind tunnel tests.

While the invention has been illustrated and described with respect to two illustrative embodiments, it will be apparent to those skilled in the art that various modifications and improvements maybe made without departing from the scope and spirit of the invention. Accordingly, the invention is not to be limited by the particular illustrative embodiments, but only by the scope of the appended claims.

I claim:

1. A projectile having an extendable fluid contacting slip-stream forking probe in its forward end, said probe being slidably movable forwardly within said projectile as a function of and in response to fluid pressure rearwardly acting on said forward end of said projectile, said projectile having probe guide means at the forward end thereof and within which said probe is slidable, said probe being peripherally smaller along its forward end zone than said guide means and being thereby substantially freely slidable along its initial forward travel within said forward end probe guide means, and said probe being peripherally larger than said forward end guide means and forming a force fit therewithin whereby said probe is frictionally restrictedly by said forward end zone probe guide means during a subsequent terminal portion of its forward travel within said guide means.

2. A projectile according to claim 1, said guide means including means disposed near the forward end of said projectile and forming a substantially free gliding fit with the forward end portion of said probe, said probe having a laterally enlarged rear guided portion forming an interference fit with said guide means and which engages with said guide means in an interference fit along the terminal path of travel of said probe within said guide means.

3. A projectile according to claim 2, further comprising set-back releasable probe-retention means retaining said probe in a retracted position prior to launching of said projectile and prior to the initial free travel of said probe within said guide means.

4. A projectile according to claim 3, said releasable retention means comprising a shear pin which is shearable as a function of set back during launch of said projectile and which is anchored in said guide means.

5. A projectile having an extendible probe in its forward end and which probe has a forward nose surface and rear pusher surface, said probe being slidably movable within said projectile, said probe having a hollow bore extending longitudinally therethrough between said forward nose surface and said rear pusher surface, said projectile having a forwardly facing cup-shaped cavity formed in its forward end, which cavity is bounded by a circumferential wall section and a rear wall section, within which cavity said probe is slidably mounted in cicumferentially effectively sealed relationship with said circumferential wall section, said probe having a front nose surface smaller in area than the area of its said rear pusher surface and being movable forwardly through said cavity as a function of the resultant differential air pressure-effecting force acting forwardly on its rear pusher surface relative to the rearward-acting drag force exerted on said probe by air pressure acting on the front nose surface by air flowing through said bore and into the rear zone of said cavity bounded by said circumferential and rear wall sections and said rear pusher surface, and forward peripheral guide means at the forward end of said cavity for slidable guiding engagement of said probe as it moves longitudinally along said cavity, said probe having a slide section slidably engageable with said guide means, said slide section including a forward zone which is smaller than and substantially freely slidable within said guide means, said slide section including a rearward zone which is slightly larger in cross-section than said forward end guide means and which forms a press fit therewithin, to thereby enable frictional press-fit locking of said probe in a forward position in which said rearward zone of said probe slide section is in press-fit frictionally retained engagement with said guide means.

6. For use as an assembly forming the forward end of a projectile, an extendible probe assembly comprising:

a cup-shaped housing having a closed base end and an open opposite forward end, with a longitudinal extending forwardly from said closed base end, a probe longitudinally slidable mounted in said housing guide bore, said probe having a nose end adjacent said open end of said housing and a piston formed at its rear end, the rear surface of which piston forms a rear pushed surface for effecting forward motion of said probe within said housing, said probe having a bore extending longitudinally therethrough between said nose end and said rear pusher surface, said housing having a piston being slidable in effectively pressure-sealing relationship within said housing bore, said probe nose end having a cross-sectional area smaller than that of said rear pusher surface, whereby a forwardly acting differential air pressure effecting force is exerted on said probe as a function of forward movement of said extendable probe assembly in the direction of said nose end of said probe and the resultant air pressure differential forces acting on the differential areas of the nose surface and the rear pusher surface of said probe, said housing having forward guide means at the forward end of said bore, which guide means has guide walls forming a guide bore for slidable guiding movement of said shaft, the forward end of said shaft being smaller in cross-section than and forming a free sliding fit with said guide means guide bore and the rearward end of said shaft being larger in cross-section than said forward guide means guide bore and forming an effectively locking interference fit therewith when said probe is slidably moved to its forward extended position.

7. An assembly according to claim 6, said rear pusher surface being formed by the rear end of said probe, which rear end is enlarged in cross-section to form a piston slightly smaller than and slidably engageable in effectively pressure-sealing relationship with said housing bore.

8. For use as an assembly forming the forward end of a projectile, an extendible probe assembly mountable in the forward end of a projectile and comprising:

a probe housing removable insertable into the forward end of a projectile, said housing having a forward-extending cup-shaped cavity having a closed base end and an open opposite forward end, with a cylindrical guide bore extending forwardly from said closed base end, a probe longitudinally slidably mounted in said guide bore, said probe having a nose end adjacent said open end of said housing and a piston formed at its rear end, the rear surface of which piston forms a rear pusher surface for effecting forward motion of said probe within said housing, said probe having a bore extending longitudinally therethrough between said nose end and said rear pusher surface, said piston being slidable in effectively pressure-sealing relationship within said housing bore, said probe nose end having a cross-sectional area smaller than that of said rear pusher surface, whereby a forwardly acting differential air pressure effecting force is exerted on said probe as a function of forward movement of said extendible probe assembly in the direction of said nose end of said probe and the resultant air pressure differential forces acting on the differential areas of the nose surface and the rear pusher surface of said probe, said housing having forward guide means at the forward end of said bore, which guide means has guide walls forming a guide bore for slidable guiding movement of said shaft, the forward end of said shaft being smaller in cross-section than and forming a free sliding fit with said guide means guide bore and the rearward end of said shaft being larger in cross-section than said forward guide means guide bore and forming an effectively locking interference fit therewith when said probe is slidably moved to its forward extended position.

9. For use as an assembly forming the forward end of a projectile, an extendible probe assembly mountable in the forward end of a projectile and comprising:

a forward-extending cup-shaped cavity having a closed base end and an open opposite forward end, with a cylindrical guide bore extending forwardly from said closed base end, a probe longitudinally slidably mounted in said housing guide bore, said probe having a nose end adjacent said open end of said housing and a piston formed at its rear end, the rear surface of which piston forms a rear pusher surface for effecting forward motion of said probe within said housing, said probe having a bore extending longitudinally therethrough between said nose end and said rear pusher surface, said piston slidable in effectively pressure-sealing relationship within said housing bore, said probe nose end having a cross-sectional area smaller than that of said rear pusher surface, whereby a forwardly acting differential air pressure effecting force is exerted on said probe as a function of forward movement of said extendible probe assembly in the direction of said nose end of said probe and the resultant air pressure differential forces acting on the differential areas of the nose surface and the rear pusher surface of said probe, said cavity bore having forward end guide means having a forward guide bore for slidable guiding movement of said shaft, the forward end of said shaft being smaller in cross-section than and forming a free sliding fit with said guide means forward guide bore and the rearward end of said shaft being larger in cross-section than said guide means forward guide bore and forming an effectively locking interference fit therewithin when said probe is slidably moved to its forward extended position.

* * * * *